US006218938B1

(12) United States Patent
Lin

(10) Patent No.: US 6,218,938 B1
(45) Date of Patent: Apr. 17, 2001

(54) ANTI-BURGLAR ALARMING DOOR BELL

(76) Inventor: Wen-Hsien Lin, PO Box 82-144, Taipei (TW)

( * ) Notice: Subject to any disclaimer, the term of this patent is extended or adjusted under 35 U.S.C. 154(b) by 0 days.

(21) Appl. No.: 09/590,701

(22) Filed: Jun. 9, 2000

(51) Int. Cl.[7] ..... G08B 21/00

(52) U.S. Cl. ..... 340/540; 340/539; 340/541; 340/545; 340/546; 340/531; 340/521

(58) Field of Search ..... 340/540, 539, 340/541, 545, 546, 531, 528

(56) References Cited

U.S. PATENT DOCUMENTS

| | | | | |
|---|---|---|---|---|
| 4,683,460 | * | 7/1987 | Nakatsukawa | 340/545 |
| 4,843,378 | * | 6/1989 | Kimura | 340/635 |
| 5,315,285 | * | 5/1994 | Nykerk | 340/426 |
| 5,483,224 | * | 1/1996 | Rankin et al. | 340/539 |
| 5,570,083 | * | 10/1996 | Johnson | 340/692 |

* cited by examiner

*Primary Examiner*—Daniel J. Wu
*Assistant Examiner*—Hung Nguyen
(74) *Attorney, Agent, or Firm*—A & J

(57) ABSTRACT

An anti-burglar alarming door bell is disclosed, and in particular, a door bell having dual wires non-polar, with anti-burglar and alarming function. The door bell comprises a detecting mechanism, a door bell/anti-burglar mode selection, a first voicing mechanism, a second voicing mechanism, a micro-computer controlled switch circuit and an alarming activation mechanism having a first indication mechanism and a second mechanism and a press button. The microcomputer receives triggered signals from the detecting mechanism (such as magnetic-spring switch or infrared detecting device) to cause the voicing mechanism to produce a sound. By means of the switching circuit, the first indication mechanism or the second indication mechanism of the alarming activation mechanism is lighted. The microcomputer causes different indication mechanisms to light and causes different voicing mechanisms to produce a sound via the alarming activation mechanism with respect to the detected status by the detecting mechanism and the door bell/anti-burglar mode selection.

8 Claims, 3 Drawing Sheets

ANTI-BURGLAR ALARMING DOOR BELL

BACKGROUND OF THE INVENTION (a) Technical Field of the Invention

The present invention relates to an anti-burglar and alarming door bell, and in particular, relates to a convenient securing device having anti-burglar and alarming function.

(b) Description of the Prior Art

Conventional security devices employ micro-computer connected with various detecting devices, for instance, a magnetic-spring switch or a infrared detecting device, such that when the door or window of the house is broken-in by burglar, the detecting devices are triggered to produce a signal to the micro-computer, which in turn, produces an alarming indication or sound. At the same time, the outside of the door is mounted with a status indication device having a plurality of LEDs to indicate various status within the house. The drawback of such security device is that the installation of cable or wires is complicated, laborious and expensive. Normally, the user is requested to pay a subscription fee to the security company providing such security system. In these conventional security devices, automatic micro-computer controllers are used to produce an alarming indication, or another control press button is used to produce an alarming ringing sound, the user returning from outside will know that there are burglars in the house. However, the user cannot activate the alarming indication outside the house. Besides, the burglar may tamper with the system within the house such that the security system cannot function normally.

SUMMARY OF THE INVENTION

Accordingly, it is an object of the present invention to provide an anti-burglar alarming door bell comprising a detecting mechanism to detect whether a security device has been illegally broken-in; a first voicing mechanism; a second voicing mechanism producing a sound different from that produced by the first voicing mechanism; an alarming activation mechanism having a press button, a first indication mechanism and a second indication mechanism, the first indication mechanism producing a color different from that produced by the second indication mechanism; a selection switch; a micro-computer and a switching circuit electrically connected with the selection switch, the detecting mechanism, the first and the second voicing mechanism and the alarming activation mechanism, allowing the switching of a common mode and an alarming mode, characterized in that when the switching circuit is at the common mode, the micro-computer causes the first indication mechanism to be lighted and the pressing of the press button causes the first voicing mechanism to produce a sound, and when the switching circuit is at the alarming mode and the detecting mechanism has not detected the security device being illegally broken-in, the micro-computer causes the second indication mechanism to be lighted, and the pressing of the press button causes the first voicing mechanisms to produce a sound, and if the switching circuit is at the alarming mode and the detecting mechanism has detected the security device being illegally broken-in, one of the first indication mechanism and the second indication mechanism produces a flashing and the pressing of the press button causes the second voicing mechanism to produce a sound.

Yet another object of the present invention is to provide an anti-burglar alarming door bell, wherein the alarming activation mechanisms are electrically connected with the switching circuit by a dual-line non-polar method such that the circuit of the door bell can be used to install with the anti-burglar alarming door bell of the present invention.

A further object of the present invention is to provide an anti-burglar alarming door bell, wherein the micro-computer can determine the pressing of the press button by a visiting guest to activate the first voicing mechanism to produce a normal door bell sound.

Yet another object of the present invention is to provide an anti-burglar alarming door bell, wherein if the house owner is away from the house, and the anti-burglar mode is selected, the micro-computer activates the second indication device to produce a light, for instance, a red LED, at the door side.

A further object of the present invention is to provide an anti-burglar alarming door bell, wherein if the house is illegally broken-in by burglar, the micro-computer activates the second voicing mechanism to produce an alarming sound to scare away the burglar, and at the same time, a red LED is produced.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
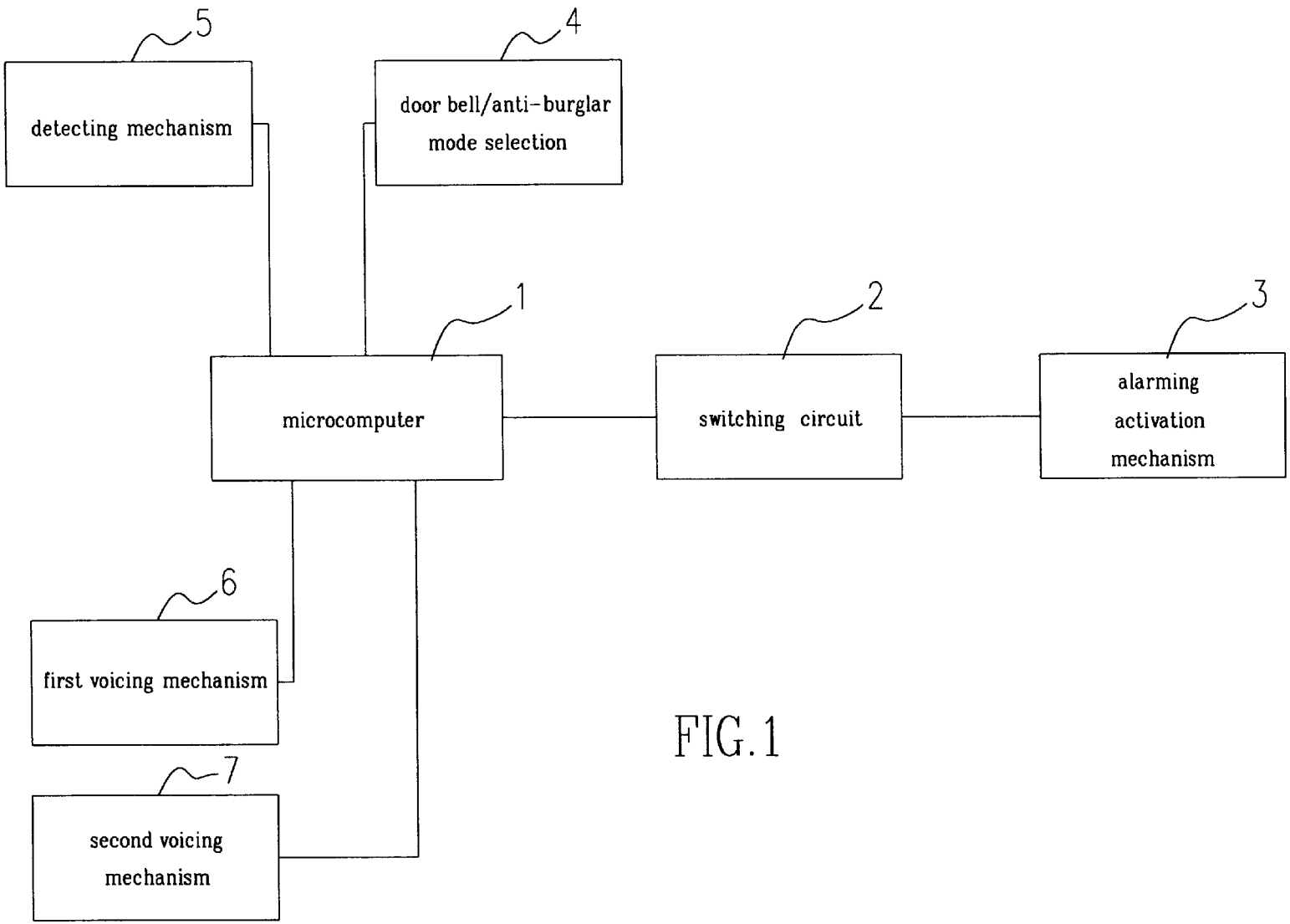
FIG. 1 is a block diagram of the alarming door bell system of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

FIG. 1 is a block diagram of the alarming door bell system of the present invention, wherein the input end of the micro-computer 1 is electrically connected to a detecting mechanism 5, for example, a magnetic-spring switch 51 or an IR (Infrared) detector 52. The detecting mechanism 5 is mounted at the window or the wall of the house so as to detect whether the house has been illegally broken in.

The output end of the micro-computer 1 is electrically connected to a first voicing mechanism 6, for instance, an electronic musical door bell, and a second voicing mechanism 7, for instance, alarming ringing sound or alarming device to scare away the burglar. The other end of the micro-computer 1 is electrically connected to an alarm activation mechanism 3 via a switching circuit 2. The mechanism 3 has the shape of a door bell panel having a press button and a first indication mechanism LED 1 and a second indication mechanism LED 2, which are respectively shown in green LED and red LED, wherein the color of the first indication LED 1 is different from that of the second indication LED 2. Similarly, the user can set the indication mechanism into a common door bell mode or anti-burglar alarming mode via a door bell/anti-burglar selector 4.

If the micro-computer 1 is to be set to common door bell mode, the first indication mechanism LED 1 of the alarming activation mechanism 3 of the circuit 2 is set to be lighted, for instance, green LED is lighted. At this moment, if the press button 31 of the door bell of the activation mechanism 3 is pressed, the micro-computer 1 causes the first voicing mechanism 6, i.e., a door bell, to produce a sound. The entire alarming door bell system is used as a common door bell function. When the micro-computer 1 is switched to anti-burglar mode, the micro-computer 1 will cause the second indication mechanism LED 2 of the alarming activation mechanism 3 to turn into red LED light via the switching circuit 2, but the first indication mechanism LED 1 will not be lighted. At this instance, if the window is illegally broken-in, the IR will produce a signal to inform the micro-computer 1, and the second voicing mechanism 7 will produce an alarming sound.

In accordance with the present invention, the different light indication mechanism on the panel of the alarming activation mechanism 3 produces a light to indicate the status of security within the house. As the colors of the LED 1 and LED 2 are different, no one will know the security system of the house being activated. As a result, the system will not be tampered with by the burglar. When an illegal broke-in action is occurred, a signal from the detecting mechanism 5 is accepted by the micro-computer 1 for processing and a time-pulse signal is delivered to produce or not to produce a lighted LED 1 or LED 2. At this instance, the owner of the house can press the door bell button 31 of the indication activation mechanism 3 so that the micro-computer 1 is activated not to sound like a door bell, and the second voicing mechanism 7 to produce an alarming sound. Therefore, the owner of the house can actively activate the door bell or the alarming device to scare away the burglar.

Figure 2:
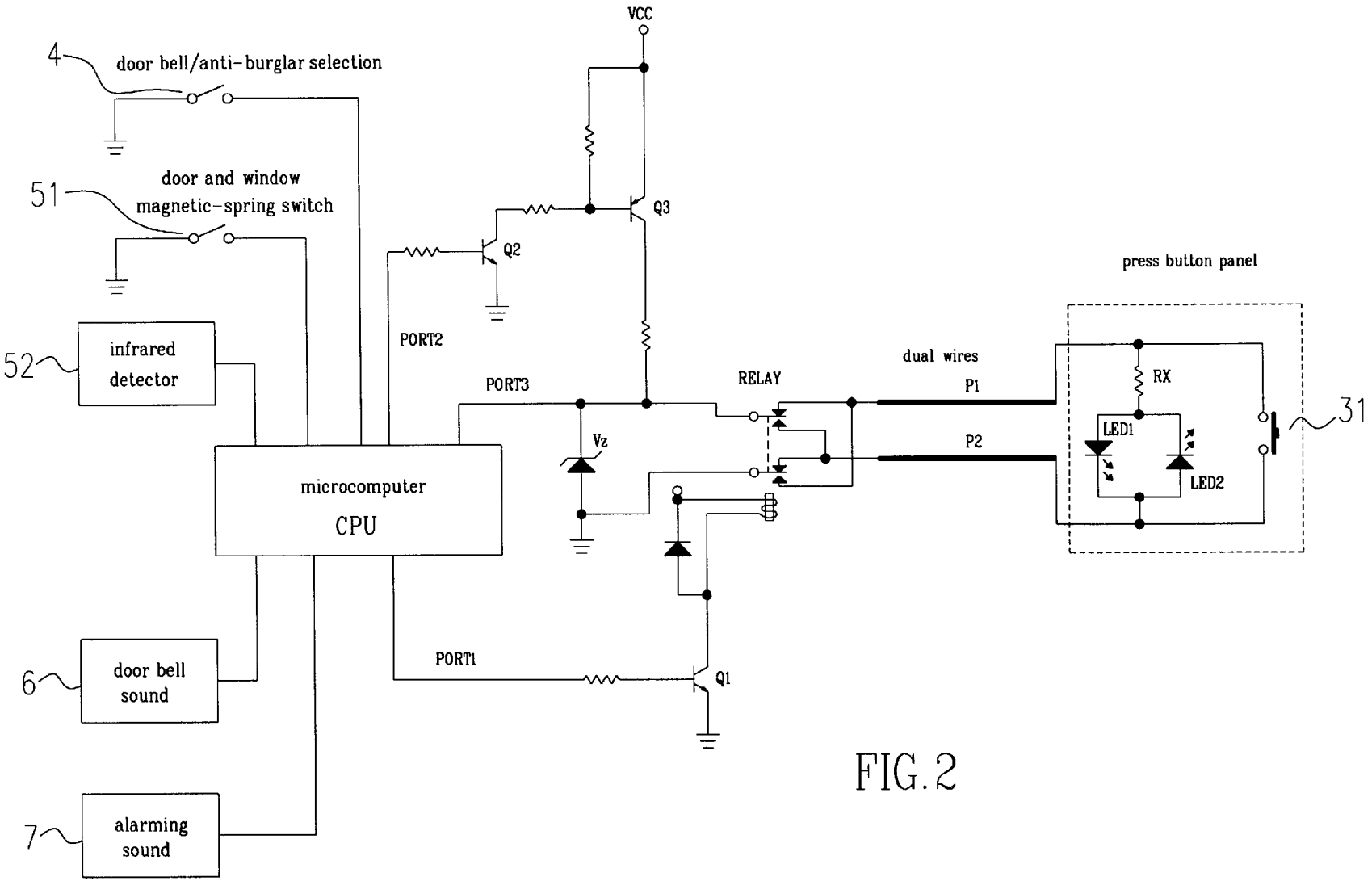
FIG. 2 is a circuit diagram of the switching circuit of the alarming door bell system of FIG. 1.
Figure 3:
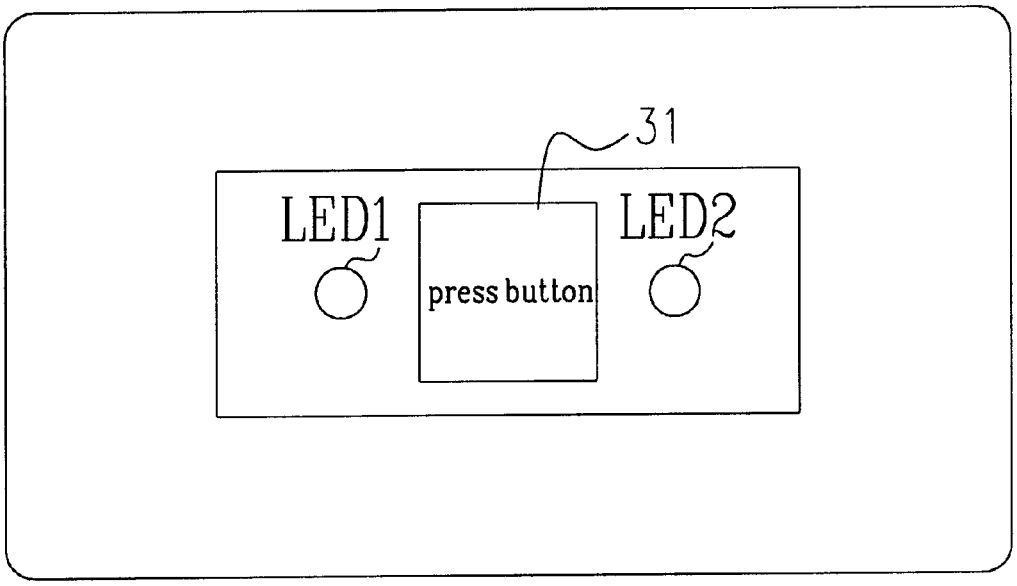
FIGS. 3 and 4 are front views of the panel of the alarming activation mechanism of the preferred embodiment of the present invention.

Referring to FIGS. 2 and 3, in view of the door bell press button 31 and the indication mechanism LED 1 and LED 2, the power supply of the entire system is the power source Vcc, and it is at a common door bell mode. The micro-computer PORT 1 outputs LO signal. At this instance transistor Q1 is OFF, and the RELAY of the switching circuit is not activated, and PORT 2 outputs a HI signal, the transistor Q2 is ON and the collection end outputs a voltage Vz, and via a normal close connection of the RELAY, the connection line P1 has a positive voltage. Connection line P2 is connected to ground, and current flows to the first indication mechanism LED 1 ground via the main resistor RX. Thus, LED 1 is lighted. At this moment, it is at a normal door bell status. When the press button 31 is pressed, P1 and P2 form a short circuit, the zener diode Vz is at LO, PORT 3 of the micro-computer receives a LO signal to confirm that the press button 31 is pressed and the door bell sound is activated.

When anti-burglar and alarming function is selected, PORT 1 of the micro-computer outputs a HI signal and the transistor Q1 is connected, and the RELAY is changed to ON. At this moment, connection line P1 is connected to ground, and the connection line P2 is at a positive voltage and current flows via the LED 2 and the resistor RX ground and the LED 2 is lighted. At this moment, the indication light is at the alarming status.

If the press button 31 is pressed, P1 and P2 become short circuit, and Vz diode is LO, PORT 3 receives a LO signal to confirm that the press button 31 is pressed and the door bell sound is activated. In other words, it is switched into an anti-burglar and alarming function. If the detecting mechanism 5 has not detected the illegal broke-in to the house, the pressing of the press button 31 provides only a door bell function, and if the LED 2 is lighted, it indicates that the anti-burglar door bell is at alarming status.

When the system is switched to anti-burglar and alarming status, and the detecting mechanism, for instance the magnetic-spring switch 51 or the IR detector 52, detects any illegal burglar, the micro-computer 1 will send a signal to cause the second voicing mechanism 7, i.e., the alarming ringing device to produce a sound, and at the same time, PORT 2 output is changed to HI, LO, HI, LO time-pulse signal such that the positive voltage of the connection line P2 causes the LED 2 to produce a flashing signal. When P2 is at A, and the press button 31 is pressed, then the diode Vz is at LO, and when the micro-computer 1 receives the signal, the alarming ringing device is activated.

In another preferred embodiment, when the system is switched to anti-burglar alarming status and if a burglar has broken-in the house, the second voicing mechanism 7, i.e. the alarming ringing device, produces a sound and then stops. When the owner of the house presses the button 31, the micro-computer 1 activates the alarming ringing device which will scare away the burglar. If the IR has detected the burglar and he has not left the house but moving around in the house, the alarming ringing device will continuous to sound until he has left the house.

Figure 4:
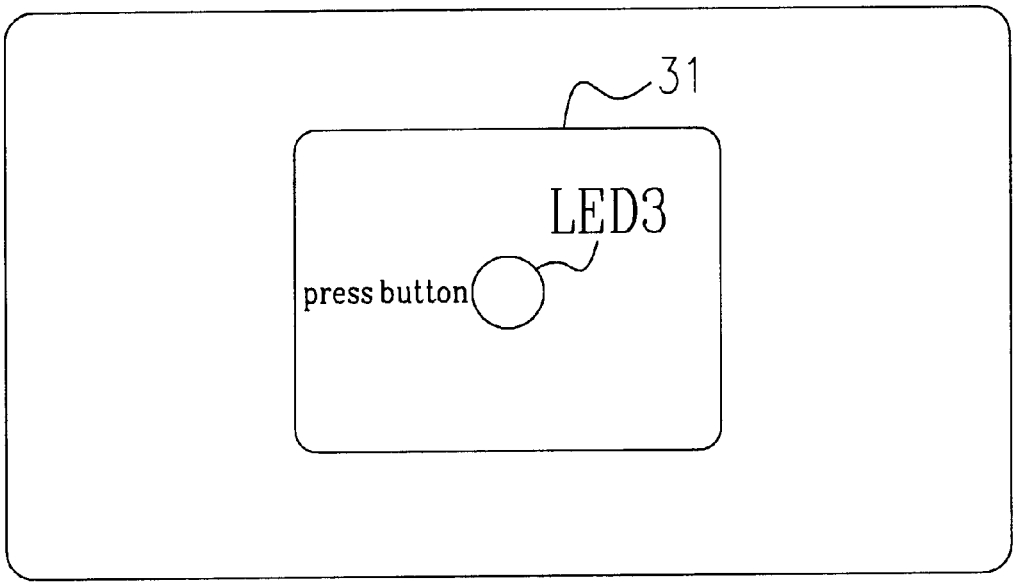

In another preferred embodiment, the LED 1 and LED 2 can be made into LED 3 which can produce different colors. The arrangement is shown in FIG. 4.

It will be understood that each of the elements described above, or two or more together may also find a useful application in other types of methods differing from the tpe described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An anti-burglar alarming door bell comprising a detecting mechanism to detect whether a security device has been illegally broken-in;

a first voicing mechanism;

a second voicing mechanism producing a sound different from that of the first voicing mechanism an alarming activation mechanism having a press button, a first indication mechanism and a second indication mechanism, the first indication mechanism producing a color different from that produced by the second indication mechanism;

a selection switch;

a microcomputer and a switching circuit electrically connected with the selection switch, the detecting mechanism, the first and the second voicing mechanism and the alarming activation mechanism, allowing the switching of a common mode and an alarming mode, characterized in that when the switching circuit is at the common mode, the micro-computer causes the first indication mechanism to be lighted and the pressing of the press button causes the first voicing mechanism to produce a sound, and when the switching circuit is at the alarming mode and the detecting mechanism has not detected the security device being illegally broken-in, the micro-computer causes the second indication mechanism to be lighted, and the pressing of the press button causes the first voicing mechanisms to produce a sound, and if the switching circuit is at the alarming mode and the detecting mechanism has detected the security device being illegally broken-in, one of the first indication mechanism and the second indication mechanism produces a flashing and the pressing of the press button causes the second voicing mechanism to produce a sound.

2. The anti-burglar alarming doorbell as set forth in claim 1, wherein the detecting mechanism is magnetic-spring switch or an infrared detector or sensors.

3. The anti-burglar alarming door bell as set forth in claim 1, wherein the first voicing mechanism is a common door bell.

4. The anti-burglar alarming door bell as set forth in claim 1, wherein the second voicing mechanism is an alarming device.

5. The anti-burglar alarming door bell as set forth in claim 1, wherein the first and the second voicing mechanism are formed integrally as one unit capable of producing various types of sound.

6. The anti-burglar alarming door bell as set forth in claim 1, wherein the first indication mechanism is a green LED and the second indication mechanism is a red LED.

7. The anti-burglar alarming door bell as set forth in claim 1, wherein the first and the second indication mechanism are integrally formed as one unit, capable of producing various dual-color LED.

8. The anti-burglar alarming door bell as set forth in claim 1, wherein the alarming activation mechanisms are electrically connected with the switching circuit by a dual-line non-polar method.

* * * * *